United States Patent [19]

Harden et al.

[11] 4,028,276

[45] June 7, 1977

[54] PRESSURE-SENSITIVE ELASTIC RESISTOR COMPOSITIONS

[75] Inventors: John Charles Harden, Wilmington; Sebastian V. R. Mastrangelo, Hockessin, both of Del.

[73] Assignee: E. I. Du Pont de Nemours & Company, Wilmington, Del.

[22] Filed: Mar. 27, 1975

[21] Appl. No.: 562,937

Related U.S. Application Data

[63] Continuation-in-part of Ser. No. 411,425, Oct. 31, 1973, abandoned.

[52] U.S. Cl. ..... 252/513; 252/511; 252/512; 252/515; 252/516; 252/519; 252/520

[51] Int. Cl.[2] ..... H01B 1/04

[58] Field of Search ..... 252/516, 511, 519, 520, 252/513, 512, 515; 51/298; 106/299; 75/DIG. 1; 338/114

[56] References Cited

UNITED STATES PATENTS

| | | | |
|---|---|---|---|
| 2,694,128 | 11/1954 | Maurin | 201/48 |
| 2,951,817 | 9/1960 | Myers | 252/511 |
| 3,180,012 | 4/1965 | Smith | 75/170 X |
| 3,410,732 | 11/1968 | Smith | 75/171 X |
| 3,451,032 | 6/1969 | Tempel | 338/114 |
| 3,571,777 | 3/1971 | Tully | 338/20 |
| 3,648,002 | 3/1972 | DuRocher | 200/166 C |
| 3,709,835 | 1/1973 | Forster | 252/513 |
| 3,875,434 | 4/1975 | Harden et al. | 338/114 X |

FOREIGN PATENTS OR APPLICATIONS

| | | |
|---|---|---|
| 2,409,009 | 8/1974 | Germany |

OTHER PUBLICATIONS

Journal of Applied Polymer Science, vol. 17, pp. 1119–1131, (1973).

Handbook of Chemistry & Physics, 49th Edition, pp. F–18, F–140.

*Primary Examiner*—Edward A. Miller
*Assistant Examiner*—E. Suzanne Parr
*Attorney, Agent, or Firm*—James A. Costello

[57] ABSTRACT

Pressure-sensitive compositions adaptable for use as elastic resistors over a wide pressure range, useful as keyboard switches or vehicle-crash sensors, comprising hard, metallic-conductive particles insulatively distributed in elastomer.

22 Claims, No Drawings

PRESSURE-SENSITIVE ELASTIC RESISTOR COMPOSITIONS

CROSS-REFERENCE TO RELATED APPLICATION

This is a continuation-in-part of copending patent application bearing U.S. Ser. No. 411,425, filed on Oct. 31, 1973, now abandoned.

BACKGROUND OF THE INVENTION

1. Field of the Invention

This invention concerns pressure-sensitive compositions comprising conductive particles distributed in dielectric elastomer. The compositions and devices that employ them can be connected in an electronic circuit and compressed to control circuit current.

2. Description of the Prior Art

Pressure-sensitive elastic resistors are commonly made by dispersing conductive particles in elastomer, disposing the resultant composition as a layer, and providing surface electrodes. Application of pressure results in the decrease from a relatively high standby resistance to a low resistance of less than 100 ohms. None of the common elastic resistors which contain particles of relatively soft materials such as silver and gold is entirely satisfactory. There is a need, then, for elastic resistor compositions that can be made simply and quickly, routinely disposed as thin layers, and provided with electrodes to achieve standardized performance over a wide range of pressure.

SUMMARY OF THE INVENTION

This invention concerns a pressure-sensitive composition adaptable for use as an elastic resistor which comprises i. metallic-conductive particles having Knoop microhardness at 100 grams applied load ($K_{100}$) of at least 500 Kg/mm$^2$, and electrical resistivity of less than 1000 microohm-cm, and ii. elastomer having an interaction parameter, Z, with said particles of from 1.2 to 1.9, said particles being distributed in the elastomer and forming a sufficient volume fraction, $\phi_F$, of the composition to provide a first relatively high resistance in the uncompressed state and a second relatively low resistance in the compressed state.

The compositions of this invention will have a standby resistance in the uncompressed state of from about 50,000 ohms up to infinity. The compositions will exhibit a broad range of relatively low resistances in the compressed state, usually from several ohms to about 20,000 ohms. It can be said that, generally, the resistance in the compressed state will differ from the resistance in the uncompressed state by a factor of at least 10 for best results.

Preferred metallic-conductive particles will have Knoop microhardness values, at a 100 gram load, of above 1000 Kg/mm$^2$. Preferred particle resistivities are less than 100 microohm-cm. Preferred Z values are between 1.50 to 1.75. Determination of Z values will be described below in the section "Particle-Elastomer Interaction".

For the purposes of this invention, $\phi_F$ means the volume fraction of the total composition occupied by the hard, metallic-conductive particles. Z, the interaction parameter, is the observable ease with which the elastomer wets and insulates the particles, quantitatively determinable with the aid of a standard Rheovibron apparatus described below, $\phi_C$ is the reciprocal of Z and is the upper limit of $\phi_F$ beyond which the quantity of elastomer present is insufficient to effectively wet and insulate more particles.

The preferred compositions of this invention have $\phi_F$ values in the range of 50 to 100 percent of $\phi_C$. The most preferred compositions for forming elastic resistors having a monitorable standby resistance will have $\phi_F$ values between 70 to 100 percent of $\phi_C$. Compositions in which $\phi_F$ is less than 50 of $\phi_C$ will require relatively large pressures to attain given low compressed-state resistances. For that reason, e.g. inconvenience, such compositions are not preferred although they are certainly contemplated within the scope of this invention.

For the sake of easy description, the particles contemplated for use herein, having the above-described Knoop microhardness values and resistivity values are called "hard, metallic-conductive" particles or, simply, "metallic-conductive" particles in this description. The term "elastomer" is used broadly to encompass elastomers (including the usual additives and adjuvants) but without the presence of the metallic-conductive particles.

DETAILS OF THE INVENTION

Metallic-Conductive Particles

The contemplated particles are derived from compounds and alloys of transition metals which have partially filled d-shells to favor covalent over ionic bonding. Included are many known compounds of transition metals with small, non-metal atoms, and certain alloys comprising a plurality of transition metals with a small non-metal atom component that characteristically have a hard Laves phase component of the $MgZn_2$ type structure.

Transition Metal Compounds

Examples of hard, metallic-conductive transition metal compounds useful herein can be found in G. Hagg, Z. phys. Chem., B 6, pages 221–232 (1929) and in P. Schwartzkopf and R. Kieffer, "Refractory Hard Metals", The Macmillan Company, N.Y. (1953), and in G. V. Samsonov "High Temperature Materials No. 2 Properties Index", Plenum Press, N.Y. (1964). Included are compounds of transition elements from scandium to nickel, yttrium to ruthenium, lanthanum to platinum, including the rare earth elements, and the actinium series. Broadly included, then, are particles of compounds selected from Groups III to VIII in the periodic arrangement of the elements, which show conductivity like metals.

Representative compounds from which particles of this invention are derived include the following.

| Compounds | Resistivities (In Microohm-Cm) | Knoop Microhardness ($K_{100}$) (in Kg/mm$^2$) |
|---|---|---|
| Group III Borides | | |
| $ScB_2$ | 7–15 | 1780 |
| $ScB_4$ | 750 | 4540 |
| $YB_6$ | 40.5 | 3264 |
| $LaB_6$ | 15.0 | 2770 |
| $CeB_6$ | 29.4 | 3140 |
| $PrB_6$ | 19.5 | 2470 |
| $NdB_4$ | 20.0 | 2540 |
| $SmB_6$ | 207 | 2500 |
| $EuB_6$ | 84.7 | 2660 |

-continued

| Compounds | Resistivities (In Microohm-Cm) | Knoop Microhardness ($K_{100}$) (in Kg/mm²) |
|---|---|---|
| $GdB_6$ | 44.7 | 2300 |
| $TbB_6$ | 37.4 | 2300 |
| $YbB_6$ | 46.6 | 2660 |
| $ThB_6$ | 14.8 | 1740 |
| Group IV Borides | | |
| TiB | 40 | 2700–2800 |
| $TiB_2$ | 14.4 | 3370 |
| $ZrB_2$ | 16.6 | 2252 |
| $HfB_2$ | 8.8 | 2900 |
| Group V Borides | | |
| $VB_2$ | 3.5 | 2800 |
| NbB | 64.5 | 2195 |
| $NbB_2$ | 34.0 | 2600 |
| TaB | 100 | 3130 |
| $TaB_2$ | 37.4 | 2500 |
| Group VI Borides | | |
| CrB | 69 | 1200–1300 |
| $CrB_2$ | 84 | 2100 |
| $Cr_2B$ | 52 | 1350 |
| $Cr_4B$ | 176 | 1240 |
| α-MoB | 45 | 2350 |
| β-MoB | 25 | 2500 |
| $MoB_2$ | 45 | 1200 |
| $Mo_2B$ | 40 | 2350 |
| $Mo_2B_5$ | 18 | 2350 |
| $W_2B_5$ | 43 | 2663 |
| Group III Carbides | | |
| ScC | 274 | 2720 |
| $YC_2$ | 88.7 | 708 |
| $Y_2C_3$ | 338 | 910 |
| ThC | 25 | 850 |
| $ThC_2$ | 30 | 600 |
| UC | 100 | 923 |
| Group IV Carbides | | |
| TiC | 52.5 | 3200 |
| ZrC | 50.0 | 2925 |
| HfC | 45.0 | 2913 |
| Group V Carbides | | |
| VC | 65 | 2094 |
| NbC | 51.1 | 1961 |
| TaC | 42.1 | 1599 |
| Group VI Carbides | | |
| $Cr_3C_2$ | 75 | 1350 |
| $Cr_7C_3$ | 109 | 1336 |
| $Cr_{23}C_6$ | 127 | 1650 |
| $Mo_2C$ | 71.0 | 1499 |
| WC | 19.2 | 1780 |
| $W_2C$ | 75.7 | 3000 |
| Group IV Nitrides | | |
| TiN | 25 | 1994 |
| ZrN | 21.1 | 1520 |
| HfN | 33.0 | 1640 |
| Group V Nitrides | | |
| VN | 85.0 | 1520 |
| $V_3N$ | 123.0 | 1900 |
| NbN | 78.0 | 1396 |
| $Nb_2N$ | 142.0 | 1720 |
| $NbN_{0.75}$ | 90.0 | 1780 |
| $NbN_{0.97}$ | 85.0 | 1525 |
| Tan | 128.0 | 1060 |
| $Ta_2N$ | 263.0 | 1220 |
| Group VI Nitrides | | |

-continued

| Compounds | Resistivities (In Microohm-Cm) | Knoop Microhardness ($K_{100}$) (in Kg/mm²) |
|---|---|---|
| CrN | 640 | 1093 |
| $Cr_2N$ | 84 | 1571 |
| $Mo_2N$ | 19.8 | 630 |
| Group III Silicides | | |
| $CeSi_2$ | 408 | 540 |
| Group IV Silicides | | |
| TiSi | 63 | 1039 |
| $TiSi_2$ | 16.9 | 892 |
| $ZrSi_2$ | 75.8 | 1063 |
| Group V Silicides | | |
| $VSi_2$ | 66.5 | 890–960 |
| $V_3Si$ | 203.5 | 1430–1560 |
| $V_5Si_3$ | 114.5 | 1350–1510 |
| $NbSi_2$ | 50.4 | 1050 |
| $TaSi_2$ | 46.1 | 1407 |
| Group VI Silicides | | |
| CrSi | 129.5 | 1005 |
| $CrSi_2$ | 914 | 704 |
| $Cr_3Si$ | 35 | 1005 |
| $Cr_5Si_3$ | 80 | 1280 |
| $MoSi_2$ | 21.6 | 707 |
| $Mo_3Si$ | 21.6 | 1310 |
| $Mo_5Si_3$ | 45.9 | 1170 |
| $WSi_2$ | 12.5 | 1074 |
| Group VIII Silicides | | |
| $CoSi_2$ | 68 | 552 |
| $NiSi_2$ | 118 | 1019 |

From the standpoint of ease of preparation and availability, compounds of Group IV to VI transition metals with small non-metal atoms such as carbon, nitrogen, silicon, boron, and germanium are preferred for use in this invention. Preferred for attaining resistance response over a wide range of pressures are titanium carbide and titanium disilicide. Titanium carbide is especially preferred.

Transition Metal Alloys

A representative class of transition metal alloys useful herein includes alloys of transition metals A and B and nonmetal silicon, and optionally, chromium. In one such alloy, A is cobalt, nickel or iron at 50 to 78 atomic percent, B is molybdenum or tungsten at 18 to 34 atomic percent, silicon is 4 to 22 atomic percent, and chromium is 0 to 28 atomic percent. Preferred alloy ranges are 56 to 68 atomic percent of A, 18 to 23 atomic percent of B, 4 to 22 atomic percent of silicon and 0 to 10 atomic percent of chromium.

Hereafter, for convenience, the alloy(s) contemplated for use in this invention may be referred to simply as "alloy", or "alloys". Operable alloys include the cobalt base alloy compositions containing substantial amounts of molybdenum and silicon described in coassigned U.S. Pat. No. 3,180,012. One operable alloy contains, by weight percent, 55Co/35Mo/10Si corresponding to 56.5Co/22Mo/21.5Si by atomic percent. On the basis of microstructure, such alloys consist of about 65 volume percent of a Laves phase of the $MgZn_2$ type structure having a microhardness ($K_{100}$) of about 1100 and about 35 volume percent of a softer matrix having a microhardness of about 340 composed of at least one or both of the intermetallic compounds $Co_2Si$ and $Co_7Mo_6$.

Accordingly, for the purposes of this invention, materials of suitable hardness include composite materials containing two or more phases having different hardnesses, provided at least one phase present as a major component has the described Knoop microhardness values.

Other useful alloys are those of cobalt, molybdenum, chromium, and silicon described in coassigned U.S. Pat. No. 3,410,732. A preferred alloy contains by weight percent 62 Co/28 Mo/8 Cr/2 Si corresponding to atomic percents 67:1 Co/18.6 Mo/9.8 Cr/4.5 Si. On the basis of microstructure, such an alloy consists of 30 to 50 volume percent Laves phase having microhardness ($K_{100}$) of 1481 Kg/mm$^2$, the balance being matrix phase having microhardness ($K_{100}$) of 735 Kg/mm$^2$. Other examples of suitable hard Laves phase alloys can be found in U.S. Pat. Nos. 3,180,012; 3,257,178; 3,331,700, and 3,361,560.

Compound and alloy particles of 0.01 to 50 microns in their largest dimension, preferably 5 to 20 microns, are suitable for use in this invention. Some small proportion of particles having their dimensions outside this range can be employed, it being appreciated however that excessively large particles are to be avoided. The particles chosen should have diameters no greater than one tenth of the layer thickness. Normal grinding procedures have been found to produce the rough particles that are most useful in the compositions of this invention.

The particles employed herein do not exhibit yield points and have high ultimate strengths to withstand interparticle stress under pressure. Preferred particles are made from materials that have higher ultimate strengths in particulate form than the bulk material itself, for example:

a. alloys comprising a plurality of transition metals with a small, non-metal atom component, which alloys exhibit no yield point and typically have ultimate strengths of about 100,000 psi in bulk form and up to 300,000 psi in particulate form, and (b) compounds of transition metals and small non-metallic atoms, similarly without yield point and having high ultimate strengths. The most preferred particles are of the transition metal compound titanium carbide which has a transverse rupture limit of 124,000 psi.

The Elastomer

The elastomer functions as a continuous dielectric matrix in which a relatively large volume fraction of particles can be insulatively distributed to achieve a relatively high standby resistance. For repetitive use, such as pressure cycling, the elastomer should provide normal elastomer recovery. That is, the elastomer itself, formulated without the particles, should be capable of being elongated at least 20 percent (ASTM D-412-61T test), usually between 20 and 500 percent, and still retract to essentially its original length. The elastomer ordinarily will be sufficiently insulative, even if additives are present, to prevent current by-pass around particles. That is, the elastomer will have substantially higher resistivity than the particle-filled elastomer.

Representative suitable elastomers are hydrocarbon rubbers including natural rubber; synthetic polyisoprene rubber, butadiene-styrene rubber, ethylene propylene-nonconjugated diene rubbers; halogenated hydrocarbon rubbers such as elastomeric chloroprene rubber; fluoroolefin rubber; silicone rubber; and rubbery condensation polymers such as polyurethane rubber obtained by reaction of polyisocyanates with polyalkylene glycols. A suitable material for this invention comprises such an elastomer containing plasticizers and/or other ingredients commonly added to elastomers, providing the properties of the resultant elastomer remain within the recited limitations.

Preferred elastomers are those that can be used in combination with many kinds of hard, metallic-conductive particles. Silicone elastomers are preferred for this reason, particularly room-temperature vulcanizable (RTV) silicone rubber curable by moisture or by catalysts. Silicone elastomers are also preferred for their retention of elastic properties in devices such as crash sensors which are exposed to low temperatures.

Particle-Elastomer Interaction

The value of the interaction parameter, Z, (called "B" in the literature) is discussed by Ziegel and Romanov in J. Appl. Polymer Science 17, 1119–42 (1973).

The value of Z is determined by use of a Rheovibron Apparatus (Direct Reading Viscoelastometer DDV-II, Toyo Baldwin Co. Ltd., Tokyo, Japan). This apparatus measures the elastic modulus of high polymer at a definite frequency of vibration. As is known, if sinusoidal tensile strain is applied at one end of the sample in a viscoelastic state, the sinusoidal stress is generated at the other end of the sample and the phase angle $\delta$ is found between the strain and the stress. By use of this apparatus, tan $\delta$ value is read directly by meter. The moduli values $E'_c$ and $E'_o$ which determine Z are calculated from the amplitude of stress and strain and the $\delta$ value.

$$Z = \frac{E_c'/E_o' - 1}{E_c'/E_o' + 1.5} / \phi_F$$

Z is a measure of the ability of the elastomer to wet hard particles; $E'_c$ is the elastic modulus of the particle-filled composition, $E'_o$ is the elastic modulus of the unfilled composition (elastomer) and $\phi_F$ is the volume fraction of the hard, metallic-conductive particles employed. The magnitude of Z is dependent upon the size and the shape of the hard particles.

It should be appreciated that the relationship between the filled and unfilled elastomer can vary slightly from the theoretical relationship that would apply if there were no chemical interaction between particles and elastomer. Any chemical interaction that takes place between the particles and elastomers described herein is expected to produce only minor variations from theory.

It should also be appreciated that the accuracy and duplicability of the determination of Z is limited by the inherent limitations in the Rheovibron method, said limitations being understood and appreciated by those skilled in the art.

Formulation of Piezoresistive Compositions

Compositions of this invention exhibit useful piezoresistive characteristics. Why useful piezoresistance occurs is not known for certain but it is believed that the explanation is as follows: The particles in said compositions are almost entirely wetted (therefore, insulated) by the elastomer in the unstressed condition. When the composition is compressed, the elastomer lying between closely spaced particles is highly compressed, and its volume decreases considerably. Thus, $\phi_F$ becomes greater than $\phi_C$ in the immediate vicinity of said particles. The result is that the surfaces of the particles become dewetted, that is, they lose their insulation. When this phenomenon occurs in many places, many conductive chains of particles are formed and the composition shows a low resistance. Monitorable unstressed resistance is believed to result from the formation of a few conductive chains due to random fluctuations in wetting and dewetting.

If all other parameters are held constant and only the size of the hard particles is varied, the smaller the particle size, the greater the resistance that will be observed at a given degree of strain. Furthermore, the smaller the particles, the greater the elastic modulus of the composition.

It is possible to lower Z by the use of additives, thereby arriving at a higher value of $\phi_c$. Additives selected to reduce physico-chemical interaction between particle and elastomer include soaps and lubricants. The use of such an additive or a mixture of such additives raises the proportion of hard particles, $\phi_f$, that can be used to produce the compositions of this invention. Useful lubricants are silicone oils, mineral oil, paraffins, and fluorocarbon derivatives. Suitable soaps are glycerol and commercially available cationic surface-modifying additives such as "Arquad" 18–50 (Armour Company). These additives can be added directly with other ingredients of the elastomer such as plasticizer, or can be incorporated via a carrier solvent in concentrations limited only by agent solubility and solvent compatibility with other ingredients. Certain dry fluorocarbon lubricants can be applied directly to the particles.

Amounts of such additives effective for reducing Z depend, inter alia, upon the particle size, the effective surface area, and the volume ratio of particles present. Suitable concentrations based on the elastomer will ordinarily, but not necessarily, range from about 0.01 to 1.0 percent by weight.

Devices and Utility

Devices and articles of manufacture are fabricable from the compositions described herein. In an article of manufacture employing a current-controlling device, the improvement of this invention comprises use of the compositions described herein as the current-controlling component. Current-control is effected by response of the novel composition to applied pressure as described herein. The improvement in the process for controlling current by means of a current-controlling device lies in controlling the current by applying and releasing pressure on the novel compositions described herein.

It is convenient to cast the flexible compositions and devices of this invention in sheets or layers to which area electrodes can be applied. As a preferred procedure it is desirable to handle the invention compositions in fluid form from which the final products can be formed in place.

The compositions, after curing the elastomer, are generally disposed as layers which can be virtually any size, shape or form. The shape and dimensions thereof are not critical since the current path length and area of cross-section can be adjusted to establish a desired level of monitorable standby resistance or matched impedance to the connecting circuitry. Layer thickness will vary with the particular use and usually will be in the range of about 1.0 to 10,000 microns, more usually 100 to 2,000 microns. The layer will normally present a surface, generally flat, designed to receive stimulus from a pressure-generating source.

To complete the formation of a current-controlling device from the pressure-sensitive composition in a layered sheet or other form, two electrodes are applied as terminals for connection to an electrical circuit. Electrode shape, size and form can vary widely in order to adjust such device characteristics as monitorable standby resistance or a high current level when fully compressed. It is not necessary to make the electrode area the same as the area over which pressure is applied, although coincidence does tend to produce an optimum response. Silver, copper, and gold paints, copper wire, straight pins, pressure-sensitive-backed metal foils, rounded spring-loaded pressure contacts (nonzero standby pressure), embedded wire screens and planar metal surfaces form suitable electrodes.

The performance of the pressure-sensitive, current-controlling compositions of this invention and the devices made therefrom enable variations in current to be obtained with accuracy and reliability. Typically, working pressures can range widely. With commercial equipment such as a Balsbaugh press it normally extends to 3,000 psi. By choosing the area of pressure application or using mechanical advantage, the amount of external pressure can be adjusted over a smaller range to suit many needed applications.

The pressure-sensitive resistance compositions of this invention are adaptable for use over such a wide pressure range by virtue of (1) the hardness of the filler particles employed and (2) the interaction parameter, 2, of the particles and the elastomeric material which provides a wetting-dewetting relationship within the operating pressure range.

The pressure range is sufficiently wide so that the preferred compositions of this invention are useful as described in coassigned application bearing U.S. Ser. No. 411,427 filed on Oct. 31, 1973 now U.S. Pat. No. 3,875,434. The described utility concerning, inter alia, a sensor logic assembly that can distinguish vehicle crash impacts by detecting speed, crash duration, and impact angle within specifications for aircushion or restraining hardness deployment in frontal impact. Those with monitorable standby resistance and a steep resistance response to pressure have special use in assemblies for vehicles where reliability is of paramount importance in actuating safety devices for passenger restraint.

In such use an electric voltage source, such as a car battery or charged capacitor, in the circuit, connected to a piezoresistive device of this invention produces sufficient current to signal crash impact. Modern, low energy input, digital transistor logic can detect such current and in turn provide an actuating signal for safety devices as required. This, in combination with the ability to monitor the presence of a sensor and its circuit connection based on preferred compositions having a finite, measurable standby resistance, permits reliable actuation of air cushions or retractable belt-/harnesses for passenger restraint.

The metallic-conductive particles used herein normally impart a small, positive temperature coefficient of resistance like that of common metals to crash sensor compositions; thus, vehicle exposure to a wide range of temperature can sometimes produce an undesirable change in standby resistance. In order to reduce such temperature sensitivity, particles of intrinsic or N-type semiconductor material having a negative temperature coefficient can be incorporated with the hard, metallic-conductive particles.

The semiconductor particles can be used to replace about 10 to 70 percent by volume of the metallic-conductive particles in providing a composition having a small temperature coefficient of resistance. Example 10 illustrates the replacement of about 25 percent of the TiC particles with germanium particles; Example 11 illustrates the replacement of about 60 percent of the TiC particles with silicon particles, the resultant compositions showing about the same electrical resistance variation with pressure as the TiC/silicone rubber composition of Example 4, but much reduced sensitivity to temperature. Broadly, in various compensated compositions, the $\phi_F$ of the unreplaced metallic-condutive particles will amount to a volume fraction of at least 0.10, preferably at least 0.30.

Piezoresistive compositions of this invention are more broadly useful in controlling current in associated circuitry. When placed between electrodes to form a pressure-sensitive, elastic resistor device and properly connected to pressure transducers and electronic logic circuits, it is possible to reliably actuate other devices such as calculator keyboards, typewriters, electrical musical instruments, floor mat sensors, weighing systems, sensory systems for use in explosion areas which require nonsparking elements, and the like.

Devices made with piezoresistive compositions of this invention will, after repeated use, show a tendency to require a higher pressure to attain a given low resistance, or they will show a higher resistance at a given pressure.

EXAMPLES

Representative pressure-sensitive compositions and their uses are illustrated by the following Examples which are meant to illustrate but not to limit this invention. Each of the compositions of each of the Examples has or is expected to have all of the distinguishing criteria of compositions of this invention. Where such criteria have been determined, they are set out.

EXAMPLE 1

A composition was prepared as follows to have 0.52 volume fraction of particles, $\phi_c$, by Rheovibron test being 0.54 for the elastomer/particle combination. A mixture of 4.5 grams of 325-mesh titanium disilicide powder (892 Kg/mm$^2$ microhardness and 16.9 microohm-cm resistivity), 1.0 gram of moisture-curable, room-temperature vulcanizable (RTV) silicone rubber (General Electric Company 112 Silicone Adhesive/-Sealer) and 1.0 cc of petroleum ether B.P. 38°–49° C to facilitate mixing was placed in a mold in sufficient amount to fill a volume between a dry lower mold closure surface and a moistened fiber board upper mold closure surface about one sixteenth-inch apart. About 2½ to 3 hours was allowed for the moisture contained in the fiber board to effect initial downward curing of the silicone rubber to the lower closure surface at ambient temperature without application of mechanical pressure to either closure surface and the cure was completed in air.

A ¼-inch diameter piece (called the pill) was punched out of the casting. Opposed electrodes were then affixed to the opposite planar surfaces of the cured, elastomeric pill to form an elastic resistor which showed a finite, monitorable electrical resistance of 1.5 megohms before application of mechanical pressure. The electrical resistance of such an elastic resistor fell to about 5000 ohms reproducibly when a hydraulic force of 25 pounds over the pill area was applied to compress the volume of the cured mixture between the affixed, opposed electrodes, such resistance value being suitable for supplying gate current to transistor-transistor logic (TTL) means using an automobile battery as a voltage source.

EXAMPLE 2

A powdered alloy having the composition of 55 percent cobalt, 35 percent molybdenum, and 10 percent silicon by weight, and a bulk density of 8.10 was prepared by arc-melting with tungsten electrode and a deep boat-shaped copper hearth to minimize contamination and weight loss and repeatedly arc-melting a sufficient number of times to insure homogeneity, said procedure of alloy formation and subsequent powder formation from said alloy being essentially as described in Example 1 of U.S. Pat. No. 3,180,012. About 80 percent of the cobalt base alloy constituted a Laves phase having microhardness of 1231 Kg/mm$^2$ on the Knoop scale at 100 gram load. The alloy was ground by jaw crushing and ball milling to form an alloy powder having an average particle size of 230-mesh and increased ultimate strength.

A mixture was formed by stirring together 9.0 grams of the alloy powder, 1.0 gram of the silicone rubber of Example 1, and 1.7 cc of petroleum ether (B.P. 38°–49° C) to facilitate mixing. The mixture was then poured into a mold as in Example 1 to a depth of about one sixteenth-inch and allowed to cure in situ as in Example 1 to form a distribution of the metallic-conductive particles in elastomeric silicone rubber having $\phi_F$ = 0.54 and $\phi_c = \phi.65$.

Opposed electrodes were applied to opposite planar surfaces to form an elastic resistor and were connected to a Simpson Ohmmeter. The monitorable standby resistance of the elastic resistor was about 10 megohms. Under the same pressure as in Example 1, the electrical resistance of the resistor dropped to just 10 ohms. Such a low resistance value was suitable for device operation.

EXAMPLE 3

Herein, 4.5 parts by weight of metallic conductive 325-mesh titanium carbide powder (3200 Kg/mm$^2$ microhardness; 52.5 microohm-cm) was surface-treated with 0.1 g cationic Arquad 18–50 (Armour Company) surface-modifying agent, which is believed to be a quaternary ammonium compound in methanol, and sufficient petroleum ether to wet the powder, and while still wet was mixed by stirring with 1.0 part by weight of the silicone rubber of Example 1. The mixture was placed in a mold and cured in situ as in Example 2 to form a distribution of the metallic-conductive particles in elastomeric silicone rubber having $\phi_F$ = 0.49. Opposed electrodes were applied as in Example 1 and serially connected to a Simpson Ohmmeter.

The monitorable standby resistance of the elastic resistor so formed was 150,000 ohms. Successive increasing pressures of 980 psi, 1960 psi, and 2940 psi applied in a Balsbaugh press reduced its resistance to 340 ohms, 19 ohms, and 4 ohms respectively, establishing the steep nonlinear resistance dependence upon pressure suitable in a sensor/logic assembly for threshold pressure activation of electrical devices.

EXAMPLES 4 to 8

Amounts of metallic-conductive titanium carbide powder (325-mesh) listed in Table 1, column 2 were each combined by stirring with 1.0 gram of the silicone rubber of Example 1. Elastic resistors were prepared with electrodes as in Example 3 and connected serially to a Simpson Ohmmeter to determine their resistances.

Standby resistances at zero pressure shown in column 4 varied from 500 ohms to 80,000 ohms as indicated by the Simpson Ohmmeter. Calculated volume fractions of particles in the elastomer are shown in column 3 based on TiC density of 4.9 and cured silicone rubber density of 0.98. Successive increasing pressures of 1000 psi, 2000 psi, and 3000 psi applied in a Balsbaugh press reduced the resistances of elastic resistors 4, 5, 6, 7 and 8 to the values as shown establishing their steep nonlinear resistance dependences upon pressure.

TABLE 1

| Example | Grams TiC | Volume Fraction $\phi_F$ | Resistance (ohms) O psi | 1000 psi | 2000 psi | 3000 psi |
|---|---|---|---|---|---|---|
| 4 | 6.0 | 0.56 | 500 | 7 | 2 | 2 |
| 5 | 5.0 | 0.51 | 10,000 | 30 | 8 | 4 |
| 6 | 4.25 | 0.48 | 20,000 | 50 | 4 | 2 |
| 7 | 4.0 | 0.46 | 10,000 | 4,000 | 50 | 20 |
| 8 | 3.75 | 0.45 | 80,000 | 5,000 | 500 | 150 |

EXAMPLE 9

A mixture of 1.0 gram of the silicone rubber of Example 1 and 1.0 cc of petroleum ether having a boiling point range of 38°–49° C was combined with 4.5 grams of 325-mesh titanium carbide powder and mixed by stirring until the powder particles were distributed uniformly. The mixture obtained was then placed into the same mold of Example 1 with a premoistened upper mold closure surface of fiber board. The mold was opened after three hours and the curing of the composition to form a thin layer ⅛-inch thick was completed in air ($\phi_F = 0.49$). A rectangular portion of the layer was cut to ¼-inch × ½-inch size, and two 2-mil copper sheet electrodes were glued to opposing planar surfaces, using a two-component conductive adhesive suitable for silicone rubber (Con RTV/II, Technit Corporation).

The cured elastomeric composition having such electrodes affixed to form an elastic resistor is characterized by its monitorable electrical resistance before application of mechanical pressure and its steep resistance dependence upon application of pressure, making it suitable for use in a sensor/logic assembly.

EXAMPLE 10

In order to prepare a pressure sensitive, temperature insensitive composition, 8.2 grams of 325-mesh intrinsically conductive germanium powder, 22.17 grams of 325-mesh titanium carbide powder, and 15 cc of petroleum ether B.P. 38° to 49° C were blended in a mortar for 5 minutes. To this blend was added 5.06 grams of the silicone rubber of Example 1 and mixing was continued for 3 minutes. By volume the final mixture contained 40.2 TiC/13.7 percent Ge/46.1 percent silicone rubber, the petroleum ether being sufficiently volatile to pass off during subsequent curing overnight in the mold described in Example 1.

A pill was cut to the same dimensions as in Example 1, electrodes affixed to opposing surfaces, and the electrical resistance under a pressure of 180 psi was measured at five different temperatures, −40°, 0°, 20°, 40°, and 80° C. The five resistance values fell in the range of about 43 to 50 ohms, i.e., 46 ohms with an average deviation of less than 5%, and the pill was elastic and sufficiently conductive when uncompressed to be electrically monitorable. Upon reapplying pressure the resistance values again decreased to essentially the same values.

EXAMPLE 11

To prepare doped silicon metal particles for temperature compensation purposes, 10 grams of 325-mesh undoped silicon metal powder was combined with 0.2 gram phosphorous nitride in a quartz tube, mixed by shaking, and placed in an oven heated to 1050° to 1100° C for 2 hours. When cooled, 6.0 grams of the resultant doped silicon powder was blended with 8.5 grams of 325-mesh titanium carbide powder and 10 cc of petroleum ether B.P. 38° to 49° C in a mortar for 5 minutes. To this blend was added 3.2 grams of the silicone rubber of Example 1 and mixing was continued for three minutes. By volume the final mixture contained 23.1 percent TiC/33.2 percent doped Si/43.7 percent RTV rubber, i.e., the volume fraction of TiC is 0.231. The petroleum ether was sufficiently volatile to pass off during subsequent curing overnight in the mold described in Example 1.

A pill was cut to the same dimensions as in Example 1, electrodes affixed to opposing surfaces, and the electrical resistance under a pressure of 180 psi was measured at −40°, 0°, 40°, and 100° C, yielding values of 7,140 ohms; 11,100 ohms; 14,300 ohms; and 20,000 ohms respectively. While more variable than the values of Example 10, the range was still sufficiently narrow over this temperature range to permit use in combination with transistor-transistor logic (TTL) set to trigger the actuation of an external device such as an automobile passive restraint device at a gate current of 1 milliampere, said current corresponding to a pill resistance of 6,000 ohms and a standard 6-volt battery.

EXAMPLE 12

A mixture of 4.0 parts by weight of titanium carbide (325-mesh) and 1.0 part by weight of an ethylene/propylene/1,4 hexadiene terpolymer (63.1/35.4/1.5) was stirred in toluene with 7%, by weight of the terpolymer, of diamylperoxide curing agent, until the TiC particles were well dispersed. The mixture was then cast in a layer about 25 mils thick on a microscope glass slide and allowed to air-dry before heating to 75° C for 2 hours. Conductive silver electrodes were then painted on the exposed surface of the dried and cured mixture to form a pressure-sensitive electrical resistor having 0.41 volume fraction of particles in an elastomer/particle matrix having $\phi_c$ of 0.54. Application of 2.9 psi of pressure decreased the resistance of the elastic resistor from 250,000 ohms to 350 ohms.

EXAMPLES 13 to 21

Various piezoresistive compositions were prepared from five metallic-conductive powders and five commercially available elastomers, identified by the following legend wherein the numbered components are curing agents.

Fluorocarbon — Copolymer of vinylidene fluoride and hexafluoropropylene of 100,000–200,000 m.w. (100 g)
1. Magnesium Oxide (1.5 g)
2. Hexamethylene diamine carbamate (2 g)
(cured) for 20 minutes at 307° F)

Silicone (1) — Silicone RN-615A (General Electric Co.) (100 g)
1. RTV-615B (10 g)
(cured for 3 hours at 167° F)

Silicone (2) — The silicone rubber of Example 1 (cured for 24 hours at room temperature)

Urethane — Urethane rubber derived from toluene-2,4-diisocyanate and 3-(alkyloxy)1,2-propanediol having an NCO content of about 25 percent (100 g)
1. Sulfur (1.5 g)
2. Zinc chloride - benzothiazyl disulfide complex (1.0 g)
3. Benzothiazyl disulfide (4.0 g)
4. 2-Mercaptobenzothiazole (1.0 g)
(Cured for 20 minutes at 310° F)

Hydrocarbon — The ethylene/propylene/1,4-hexadiene terpolymer of Example 12 (100 g)
1. Zinc oxide (5 g)
2. Stearic acid (1 g)
3. Sulfur (2 g)
4. Zinc dibutyldithiocarbamate (2 g)
5. Tetramethyl-thiuram disulfide (0.5 g)
6. Benzothiazyl disulfide (1 g)
(Cured for 20 minutes at 320° F)

A Rheovibron Direct Reading Dynamic Viscoelastometer Model DDV-II was used to measure the dynamic storage moduli $E'_c$ of the prepared compositions and $E'_o$ of unfilled elastomeric materials (similarly cured) at 5° C intervals from 20° to 65° C. Values of Z and $\phi_c$ as indicated were calculated according to Ziegel and Romanov (cited above) and were relatively constant with temperature.

The compositions and their properties are set out in Table 2. The resistance in the compressed state was determined by applying pressures of up to 200 psi, at ambient temperatures. The standby resistance was also determined at ambient temperatures.

The Z and $\phi_c$ values of the composition of Example 21 varied as indicated over a temperature range of 22° C to 65° C. Said composition comprised, in atomic percent, 67.1 percent cobalt, 18.6 percent molybdenum, 4.5 percent silicon and 9.8 percent chromium.

Elastic resistors were prepared by casting and curing the compositions shown in Table 2 to form cured layers about 0.070 cm (700 microns) thick, 2.20 cm long and 0.4 cm wide (except for the sample prepared with the silicone rubber (1) and TiC which was only 0.5 cm long). The volume fractions of particle fillers shown in Table 2 were calculated from the amounts of materials employed.

TABLE 2

| Example No. Comparison Letter | Particles | Elastomer | Z | $\phi_c$ | $\phi_F$ | Standby Resistance (ohms) | Lowest Resistance When Compressed (ohms) |
|---|---|---|---|---|---|---|---|
| Comparison A | Ag | Fluorocarbon | 0.91 | 1.09 | .26 | 12.5 | 10 |
| 13 | TiC | Silicone (1) | 1.20 | .83 | .50 | $2.5 \times 10^{10}$ | 500 |
| 14 | TiSi | Silicone (2) | 1.42 | .68 | .42 | $5 \times 10^{10}$ | 10 |
| 15 | 55 Co/ 35 Mo/ 10 Si (by weight) | Silicone (2) | 1.57 | .65 | .52 | $5 \times 10^{10}$ | 7 |
| 16 | TiC | Urethane | 1.60 | .63 | .54 | $3.8 \times 10^{7}$ | 210 |
| 17 | TiC | Silicone (2) | 1.64 | .61 | .50 | $1.7 \times 10^{8}$ | 8 |
| 18 | TiC | Hydrocarbon | 1.65 | .61 | .54 | $2.5 \times 10^{9}$ | 25 |
| Comparison B | Ag | Silicone (2) | 1.69 | .60 | .52 | 11.9 | 20 |
| 19 | TiC | Hydrocarbon | 1.87 | .54 | .45 | $1.8 \times 10^{7}$ | 25 |
| 20 | $TiSi_2$ | Silicone (2) | 1.90 | .54 | .44 | $5 \times 10^{10}$ | 650 |
| 21 | 62 Co/ 28 Mo/ 8 Cr/ 2 Si (by weight) | Silicone (1) | 1.45 to 1.90 | .83 to .54 | .51 | $2.5 \times 10^{5}$ | 7 |

The embodiments of the invention in which an exclusive property or privilege is claimed are defined as follows:

1. A pressure-sensitive composition adaptable for use as an elastic resistor which comprises i. metallic-conductive particles having Knoop microhardness at 100 grams applied load ($K_{100}$) of at least 500 Kg/mm$^2$, and electrical resistivity of less than 1000 microohm-cm, and being from 0.01 to 50 microns in their largest dimension, said particles being selected from at least one member of the group consisting of (a) the electrically conductive borides, carbides, nitrides, silicides and germanides of a transition metal selected from Periodic Groups III through VIII, and (b) the alloy of metal A, metal B, silicon and, optionally, chromium, metal A being cobalt, nickel or iron present at 50 to 78 atomic percent, metal B being molybdenum or tungsten present at 18 to 34 atomic percent, Si being present at 4 to 22 atomic percent, and chromium being present at 0 to 28 atomic percent, and ii. elastomer having an interaction parameter, Z, with said particles of from 1.5 to 1.75, said particles being distributed in the elastomer to form a volume fraction, $\phi_F$, of the composition that provides a first relatively high resistance in the uncompressed state and a second relatively low resistance in the compressed state; the value for Z being determined by the equation $$Z = \frac{E_c'/E_o'-1}{E_c'/E_o'+1.5} / \phi_r$$

wherein $E_c'$ is the elastic modulus of the particle-filled elastomer composition and $E_o'$ is the elastic modulus of the unfilled elastomer.

2. A composition according to claim 1 wherein the Knoop microhardness is at least 1000 Kg/mm², and the electrical resistivity is less than 100 microohm-cm.

3. A composition according to claim 1 wherein the volume fraction of particles in the composition is between 50 to 100 percent of the value of the reciprocal of Z.

4. A composition according to claim 1 wherein the elastomer is capable of being elongated by at least 20 percent of its length and still retracting to essentially its original length, said elastomer being at least one member of the group consisting of natural rubber, synthetic polyisoprene rubber, butadiene-styrene rubber, ethylene propylene-non-conjugated diene rubber, halogenated hydrocarbon rubber, fluoroolefin rubber, silicone rubber, and rubbery condensation polymer.

5. A composition according to claim 1 wherein the particles are selected from at least one member of the group consisting of titanium carbide, titanium silicide, titanium disilicide, and the alloy.

6. A composition according to claim 5 wherein the particles are titanium carbide.

7. A composition according to claim 5 wherein the particles are titanium silicide.

8. A composition according to claim 5 wherein the particles are titanium disilicide.

9. A composition according to claim 5 wherein the particles are of the alloy.

10. A composition according to claim 9 wherein the alloy comprises 56 to 68 atomic percent of metal A, 18 to 23 atomic percent of metal B, 4 to 22 atomic percent of silicon and 0 to 10 atomic percent of chromium.

11. A composition according to claim 1 wherein the particles are metallic-conductive particles and semiconductive particles, said semiconductive particles being intrinsic or N-type material having a negative temperature coefficient and replacing from about 10 to 70 percent by volume of the metallic-conductive particles.

12. A composition according to claim 11 wherein the metallic-conductive particles are titanium carbide and the semiconductive particles are germanium.

13. A composition according to claim 11 wherein the metallic-conductive particles are titanium carbide and the semiconductive particles are silicon.

14. A composition according to claim 5 wherein the elastomer is selected from the group consisting of silicone rubber, hydrocarbon rubber, polyfluorocarbon rubber and polyurethane rubber.

15. A composition according to claim 14 wherein the particles are titanium carbide and the elastomer is silicone rubber.

16. A composition according to claim 14 wherein the particles are of the alloy comprising 56.5 Co/22 Mo/21.5 Si by atomic ratio, and the elastomer is silicone rubber.

17. A composition according to claim 14 wherein the particles are titanium carbide and the elastomer is a terpolymer of ethylene, propylene and 1,4-hexadiene.

18. A composition according to claim 14 wherein the particles are titanium carbide and the elastomer is polyurethane rubber.

19. A composition according to claim 14 wherein the particles are titanium carbide and the elastomer is hydrocarbon.

20. A composition according to claim 14 wherein the particles are titanium silicide and the elastomer is silicone rubber.

21. A composition according to claim 14 wherein the particles are titanium disilicide and the elastomer is silicone rubber.

22. A composition according to claim 1 comprising, additionally, a soap or lubricant additive.

* * * * *